US006109964A

United States Patent [19]

Kooiman

[11] Patent Number: 6,109,964

[45] Date of Patent: Aug. 29, 2000

[54] ONE PIECE CONNECTOR FOR A COAXIAL CABLE WITH AN ANNULARLY CORRUGATED OUTER CONDUCTOR

[75] Inventor: John A. Kooiman, Lockport, Ill.

[73] Assignee: Andrew Corporation, Orland Park, Ill.

[21] Appl. No.: 09/271,390

[22] Filed: Mar. 19, 1999

Related U.S. Application Data

[60] Provisional application No. 60/080,803, Apr. 6, 1998.

[51] Int. Cl.[7] ..... H01R 9/05

[52] U.S. Cl. ..... 439/583; 439/578

[58] Field of Search ..... 439/578, 584, 439/583, 610

[56] References Cited

U.S. PATENT DOCUMENTS

| | | | |
|---|---|---|---|
| 3,199,061 | 8/1965 | Johnson et al. | 339/100 |
| 3,291,895 | 12/1966 | Van Dyke | 174/88 |
| 4,046,451 | 9/1977 | Juds et al. | 339/177 |
| 5,021,010 | 6/1991 | Wright | 439/578 |
| 5,137,470 | 8/1992 | Doles | 439/578 |
| 5,154,636 | 10/1992 | Vaccaro et al. | 439/583 |
| 5,167,533 | 12/1992 | Rauwolf | 439/583 |
| 5,354,217 | 10/1994 | Gabel et al. | 439/578 |
| 5,435,745 | 7/1995 | Booth | 439/584 |
| 5,561,900 | 10/1996 | Hosler, Sr. | 29/828 |
| 5,567,171 | 10/1996 | Mizuguchi | 439/326 |
| 5,802,710 | 9/1998 | Bufanda et al. | 29/828 |

*Primary Examiner*—Gary F. Paumen
*Assistant Examiner*—Edwin A. Leóon
*Attorney, Agent, or Firm*—Jenkens & Gilchrist

[57] ABSTRACT

A connector assembly for a coaxial cable having an annularly corrugated outer conductor is provided. The connector assembly includes a first body member adapted to fit over the end of the coaxial cable and forming a series of apertures spaced around the circumference of the first body member near one end thereof. The connector assembly further includes a second body member that forms a clamping surface for engaging the inner surface of the corrugated outer conductor adjacent the last crest in the corrugated outer conductor. The connector assembly also includes multiple ball bearings seated in the apertures and captured between the first and second body members. A connecting means is provided for drawing and holding the first and second body members together so as to draw the clamping surface and the ball bearings against the inner and outer surfaces, respectively, of the outer conductor.

In one embodiment, the ball bearings are larger than the apertures and are positioned on the outer surface of the first body member. The second body member forms a cam surface for engaging the outer portions of the ball bearings and urging the ball bearings into the apertures as the first and second body members are drawn together such that the inner portions of the ball bearings extend through the apertures and press against the outer surface of the outer conductor.

40 Claims, 14 Drawing Sheets

ONE PIECE CONNECTOR FOR A COAXIAL CABLE WITH AN ANNULARLY CORRUGATED OUTER CONDUCTOR

CROSS-REFERENCE TO RELATED APPLICATION

This application claims the benefit of now abandoned Provisional Patent Application Serial No. 60/080,803 filed Apr. 6, 1998.

FIELD OF THE INVENTION

This invention relates generally to connectors for coaxial cables, and, more particularly, to connectors for coaxial cables which have annularly corrugated outer conductors.

BACKGROUND OF THE INVENTION

Coaxial cable is characterized by having an inner conductor, an outer conductor, and an insulator between the inner and outer conductors. The inner conductor may be hollow or solid. At the end of coaxial cable, a connector is attached to allow for mechanical and electrical coupling of the coaxial cable.

Connectors for coaxial cables have been used throughout the coaxial cable industry for a number of years. For example, U.S. Pat. No. 5,167,533 (Rauwolf) describes a connector for coaxial cables having hollow inner conductors. U.S. Pat. No. 5,154,636 (Vaccaro et al.) describes a connector for coaxial cables having helically corrugated outer conductors. U.S. Pat. No. 5,137,470 (Doles) describes a connector for coaxial cables having hollow and helically corrugated inner conductors. U.S. Pat. No. 4,046,451 (Juds et al.) describes a connector for coaxial cables having annularly corrugated outer conductors and plain cylindrical inner conductors. U.S. Pat. No. 3,291,895 (Van Dyke) describes a connector for cables having helically corrugated outer conductors and hollow, helically corrugated inner conductors.

A connector for a coaxial cable having a helically corrugated outer conductor and a hollow, plain cylindrical inner conductor is described in U.S. Pat. No. 3,199,061 (Johnson et al.). The Johnson patent describes a self-tapping connector for the inner conductor of a coaxial cable. Such connectors are time-consuming to install and expensive to manufacture. Also, when the inner connector is made of brass, overtightening causes the threads to strip off the connector rather than the end portion of the inner conductor of the cable, and thus the connector must be replaced.

U.S. Pat. No. 5,435,745 (Booth) describes a connector for coaxial cables having a corrugated outer conductor. The Booth patent discloses a connector which utilizes a nut member which has a longitudinally slotted generally cylindrical barrel portion defining a number of barrel segments or fingers. The inner surfaces of the barrel segments or fingers are flat, so as to define a composite inner barrel surface which is hexagonal. A tapered bushing or inner surface of the connector engages the outer surface of the barrel and deforms the fingers defined by the slots of the barrel into contact with the corrugated outer conductor.

Therefore, there is a continuing need for improved high performance coaxial cable connectors that are easy and fast to install and un-install, particularly under field conditions; are pre-assembled into one piece connectors, so that the possibility of dropping and losing small parts, misplacing O-rings, damaging or improperly lubricating O-rings, or other assembly errors in the field is minimized; is installed and removed without the use of any special tools; and is efficiently and economically manufactured.

SUMMARY OF THE INVENTION

In accordance with the present invention, a connector assembly for a coaxial cable having an annularly corrugated outer conductor is provided. The connector assembly includes a first body member adapted to fit over the end of the coaxial cable and forming a series of apertures spaced around the circumference of the first body member near one end thereof. The connector assembly further includes a second body member that forms a clamping surface for engaging the inner surface of the corrugated outer conductor adjacent the last crest in the corrugated outer conductor. The connector assembly also includes multiple ball bearings seated in the apertures and captured between the first and second body members. A connecting means is provided for drawing and holding the first and second body members together so as to draw the clamping surface and the ball bearings against the inner and outer surfaces, respectively, of the outer conductor.

In one embodiment, the ball bearings are larger than the apertures and are positioned on the outer surface of the first body member. The second body member forms a cam surface for engaging the outer portions of the ball bearings and urging the ball bearings into the apertures as the first and second body members are drawn together such that the inner portions of the ball bearings extend through the apertures and press against the outer surface of the outer conductor.

BRIEF DESCRIPTION OF THE DRAWINGS

FIG. 11*c* is a perspective view of an insulator for the modified connector of FIG. 11*a.

DETAILED DESCRIPTION OF THE PREFERRED EMBODIMENTS

Figure 1:
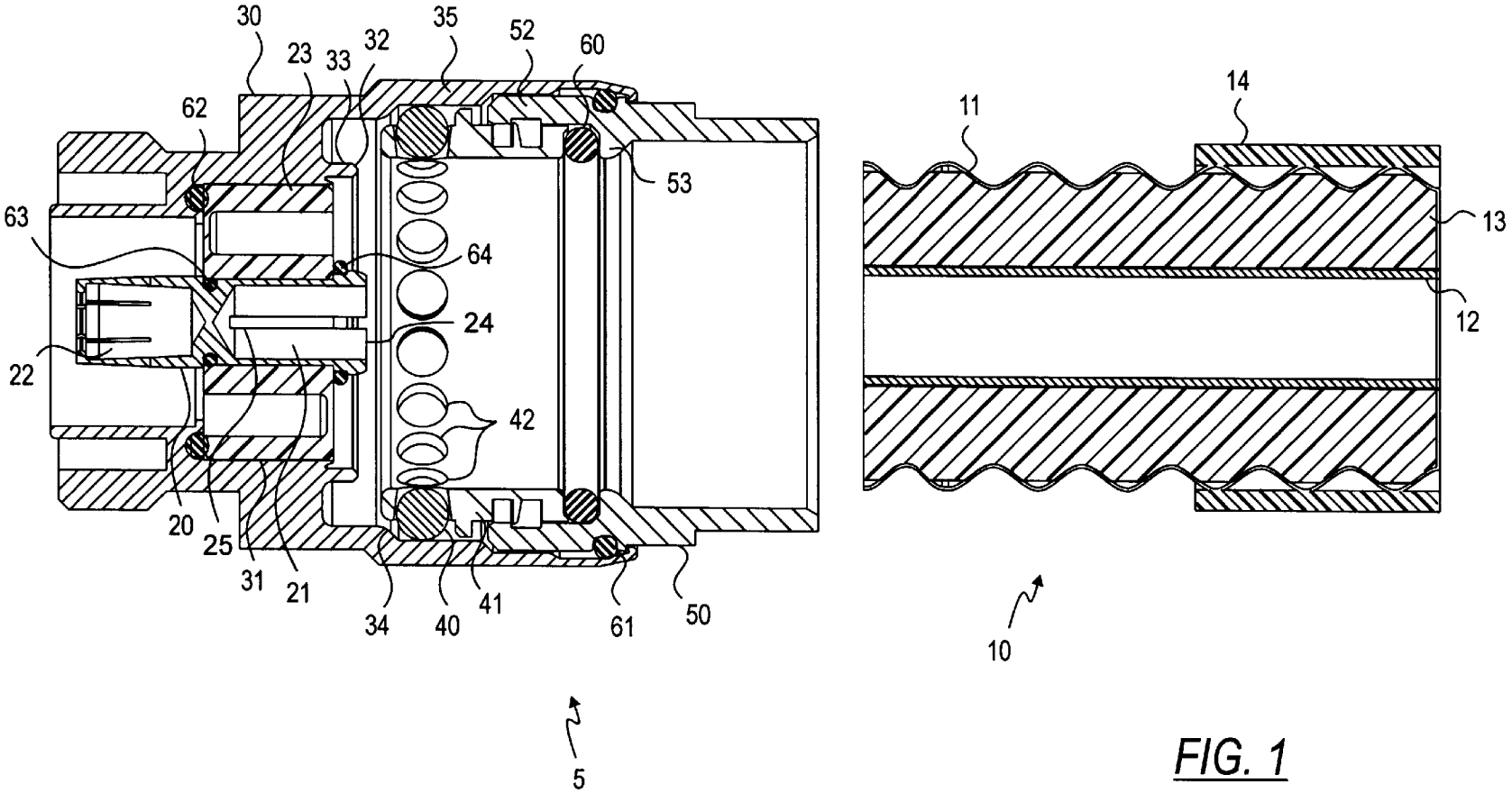
FIG. 1 is a longitudinal section through the center of a connector which embodies the present invention and a coaxial cable having an annularly corrugated outer conductor to be attached to one end of the connector, with the cable detached from the connector.

Although the invention will be described in connection with certain preferred embodiments, it will be understood that it is not intended to limit the invention to those particular embodiments. On the contrary, it is intended to cover all alternatives, modifications, and equivalents that may be included within the spirit and scope of the invention as defined by the appended claims.

Turning now to the drawings, there is shown a connector assembly 5 for a coaxial cable 10 having an annularly corrugated outer conductor 1 1 concentrically spaced from a hollow inner conductor 12 by a foam dielectric 13. As is well known to those familiar with this art, an "annularly" corrugated conductor is distinguished from a "helically" corrugated conductor in that the annular corrugations form a series of spaced parallel crests which are discontinuous along the length of the cable and, similarly, a series of spaced parallel valleys which are also discontinuous along the length of the cable. That is, each crest and valley extends around the circumference of the conductor only once, until it meets itself, and does not continue in the longitudinal direction. Consequently, any transverse cross-section taken through the conductor perpendicular to its axis is radially symmetrical, which is not true of helically corrugated conductors.

To prepare the cable 10 for attachment of the connector assembly 5, the end of the cable 10 is cut along a plane extending through the apex of one of the crests of the corrugated outer conductor 11 and perpendicular to the axis of the cable 10. This exposes the clean and somewhat flared inner surface of the outer conductor 11. The foam dielectric 13 normally does not fill the crests of the corrugated outer conductor 11, so a small area of the inner surface of the outer conductor 11 is exposed adjacent the cut end of the conductor 11 at the apex of the crest through which the cut is made. The foam in this region is preferably compressed radially inward during cable preparation in order to provide sufficient clearance to permit contact with the inner surface of the outer conductor 11 adjacent the cut end thereof. Any burrs or rough edges on the cut ends of the metal conductors 11, 12 are preferably removed to avoid interference with the connector assembly 5. The outer surface of the outer conductor 11 is normally covered with a plastic jacket 14 which is trimmed away from the end of the outer conductor 11 along a sufficient length to accommodate the connector assembly 5.

In one embodiment, the connector assembly 5 includes a front body member 30, a rear body member 50 that telescopes under a portion of the front body member 30, and a bearing sleeve 41 that is captured within the rear body member 50. The bearing sleeve 41 is connected to the rear body member 50 by a mechanical fastener. In one embodiment, the mechanical fastener includes spring tabs that extend radially outward from the bearing sleeve 41 to lock into a corresponding groove disposed on the interior surface of the rear body member 50. The connector assembly 5 is preferably sold as a one piece unit that requires no assembly by the user. This facilitates easy installation to the cable 10 and improves safety by reducing the likelihood that the installer will drop tools and/or a portion of the assembly 5 from dangerous heights as a result of struggling with several connector components.

In another embodiment, electrical contact with the inner conductor 12 of the cable 10 is effected by an inner connector element 20 which includes a C-shaped spring 21 (illustrated in FIGS. 1–4). The C-shaped spring 21 produces a tapered, or gradually increasing, spring force when inserted into the hollow inner conductor 12. The C-shaped spring 21 thus makes a high force spring contact when fitted into the inner conductor 12. The spring 21 includes a generally tubular section and a generally tubular end section having an end 24. The generally tubular section is adjacent and integral with the end section. The end section has a single slit 25 extending longitudinally from the end 24 along the end section so as to form the C-shaped spring 21. The spring 21 is resiliently adaptable to fit into the hollow inner conductor 12 to make good electrical contact.

Maximum contact pressure occurs at or near the interface surfaces of the spring 21 and the inner diameter of the inner conductor 12. This minimizes any discontinuity to the current flow on the surface of the inner conductor 12, and thereby minimizes any degradation of return loss performance. This tapered-C spring contact improves intermodulation distortion stability because the C-shaped spring 21 resists movement of the cable center conductor, in the presence of externally applied forces, which minimizes nonlinear effects due to changes in either contact resistance or in the physical point of contact between the connector 5 and the cable 10 and/or a conventional complementary male member (not shown). Therefore, the tapered-C spring contact provided by the C-shaped spring 21 is solid and stable thus minimizing intermodulation distortion.

A set of spring fingers 22 is formed on the opposite end of the inner connector element 20 for connecting the inner conductor 12 to a conventional complementary male member (not shown). An insulator 23 centers the element 20 within the front body member 30 of the connector assembly 5 while electrically isolating the element 20 from the front body member 30. It will be noted that the interior of the front body member 30 includes a recess 31 for receiving the insulator 23, as is conventional in coaxial cable connectors.

In a further embodiment, electrical contact with the inner conductor 12 of the cable 10 is effected by a conventional inner connector element 20' forming multiple spring fingers 21' (illustrated in FIGS. 9*a* and 9*b*) which are deflected slightly inwardly as they are inserted into the hollow conductor 12, so that the resulting spring forces hold the spring fingers 21' tightly against the inside surface of the inner conductor 12.

In another embodiment, electrical contact with a solid inner conductor (not shown) is effected by a connector element that includes a C-shaped female spring that makes a high force spring contact with the outer surface of the solid inner conductor when fitted over a portion of the solid inner conductor.

In still another embodiment, electrical contact with a solid inner conductor (not shown) is effected by a connector element that includes multiple female spring fingers that are adapted to fit over a portion of the solid inner conductor.

Figure 2:
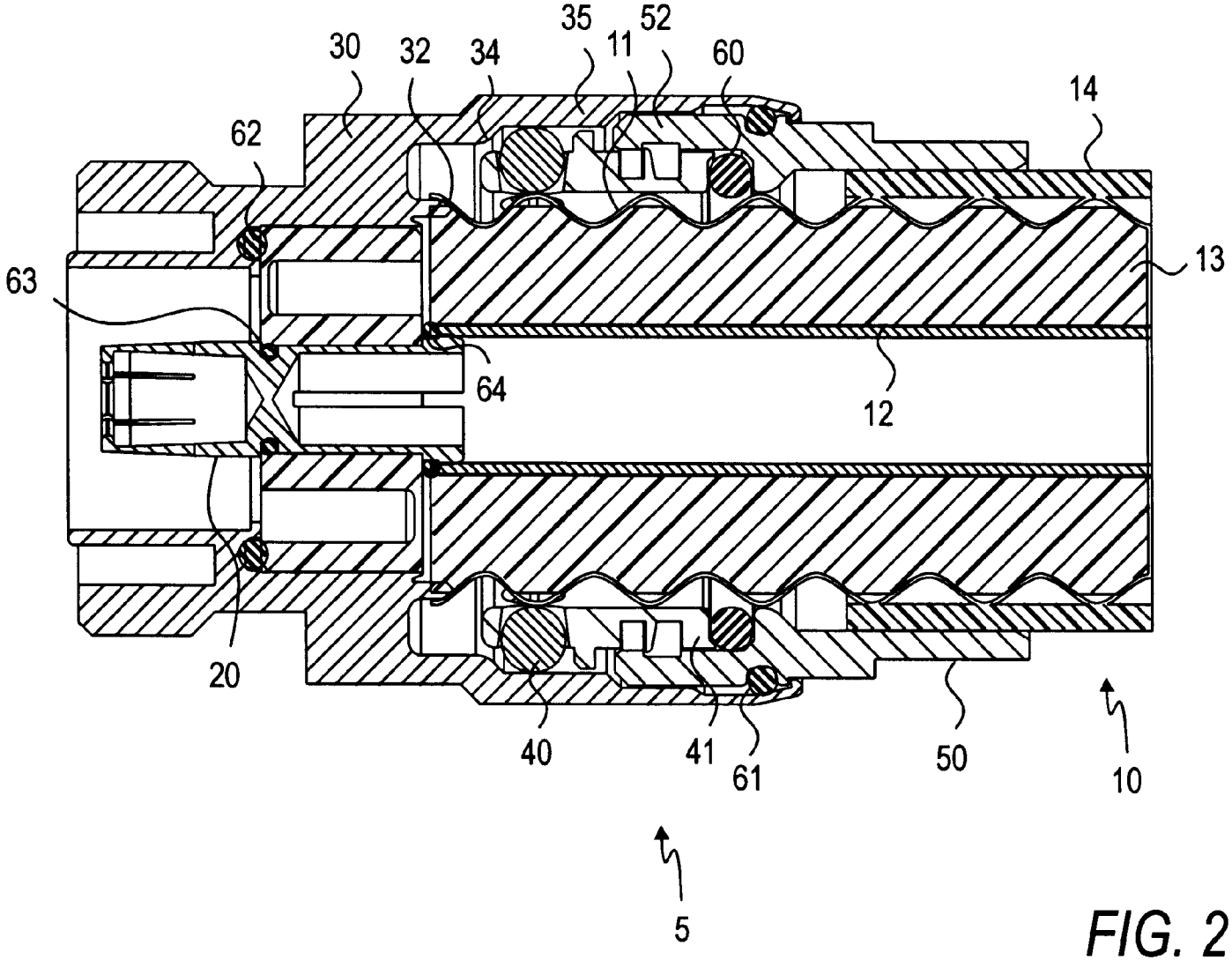
FIG. 2 is the same longitudinal section shown in FIG. 1 with the front portion of the connector attached to the coaxial cable, and the rear portion partially installed.
Figure 3:
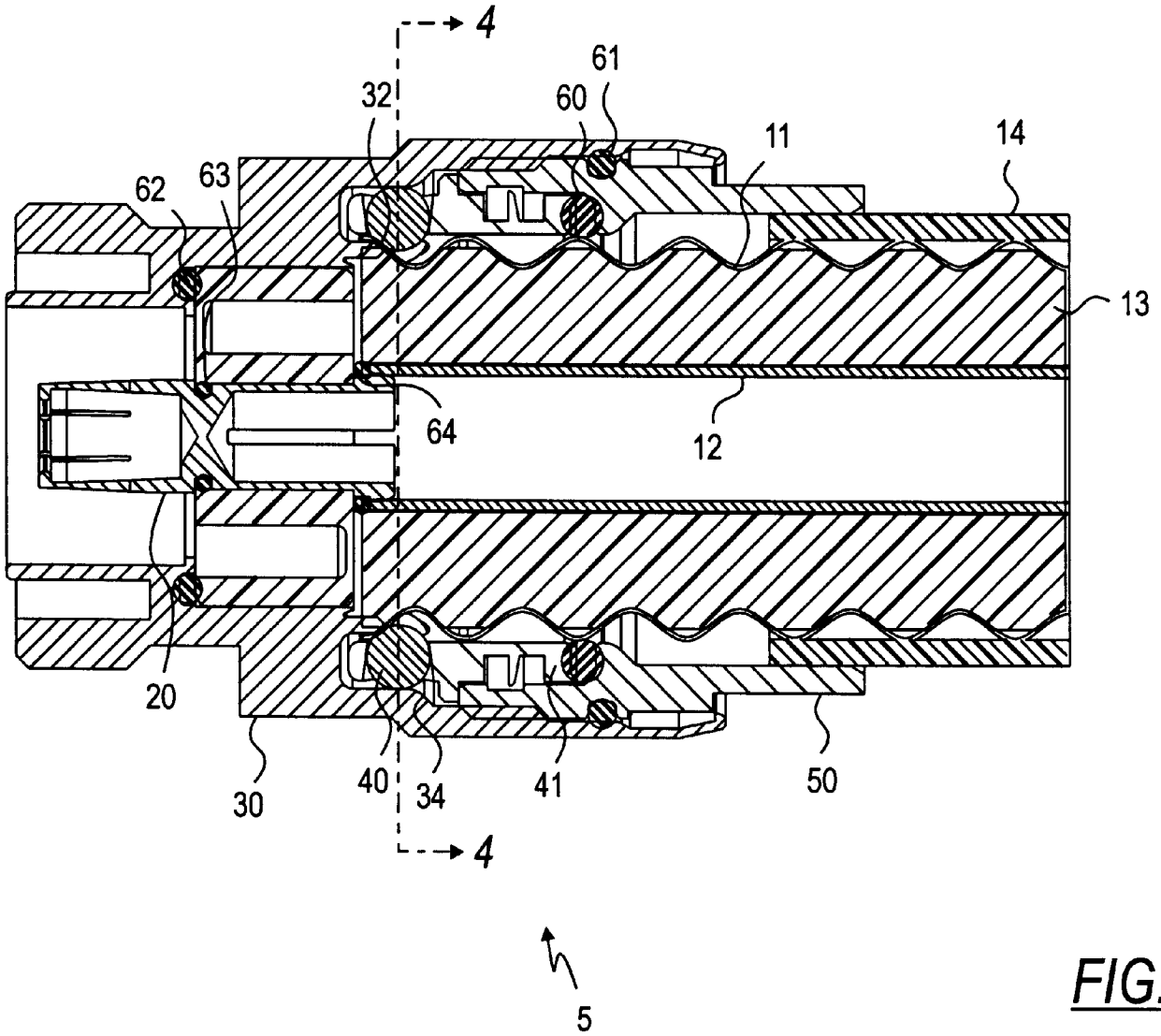
FIG. 3 is the same longitudinal section shown in FIG. 1 with the connector fully installed on the cable.
Figure 4:
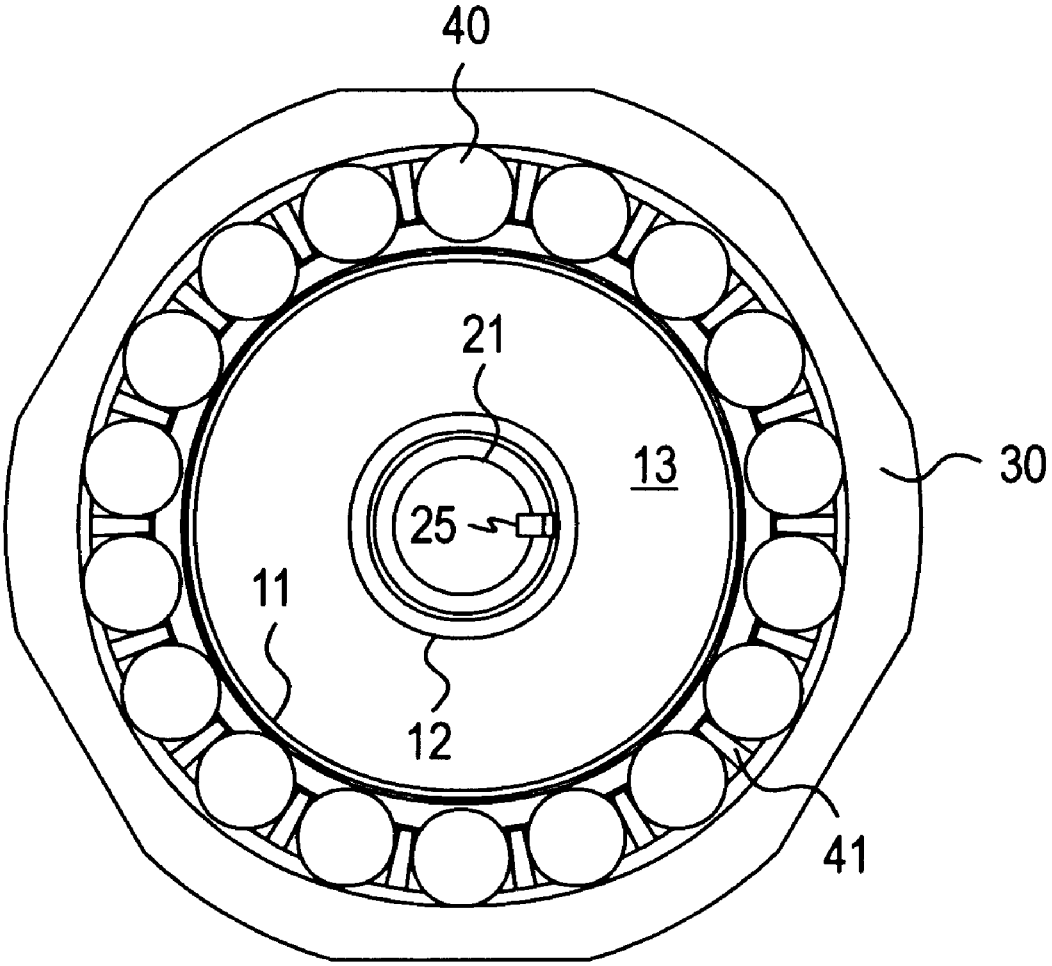
FIG. 4 is a section taken generally along the line 4—4 in FIG. 3.
Figure 5:
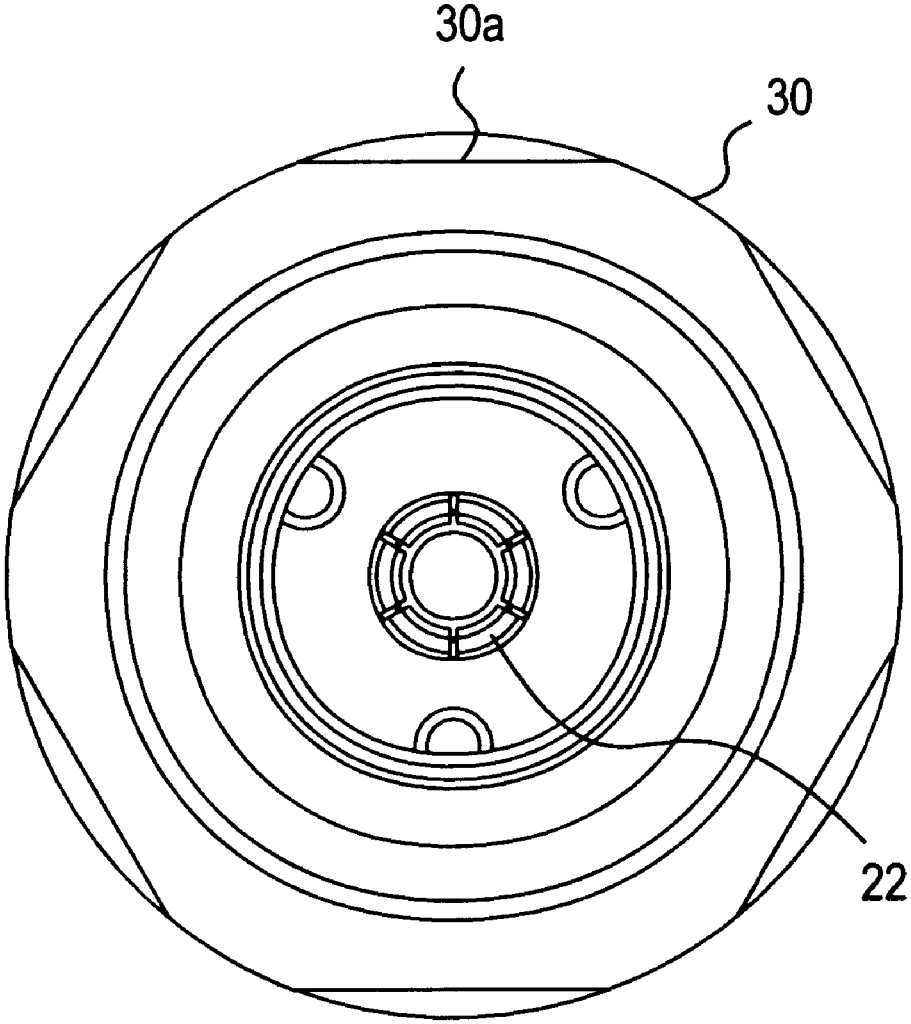
FIG. 5 is an end elevation taken from the front end of the connector that is shown in longitudinal section in FIG. 1.
Figure 6:
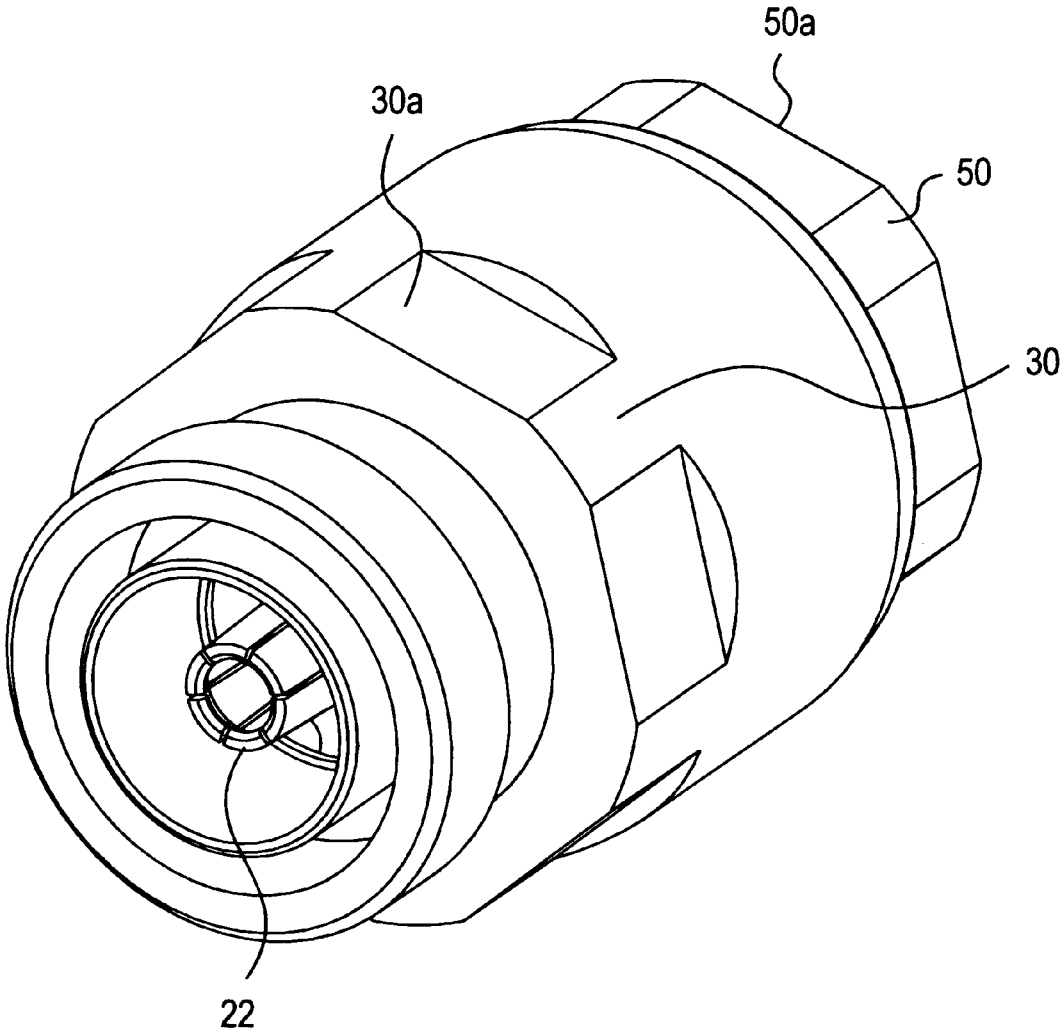
FIG. 6 is a perspective view taken from the front end of the connector assembly of FIGS. 1–5.
Figure 7:
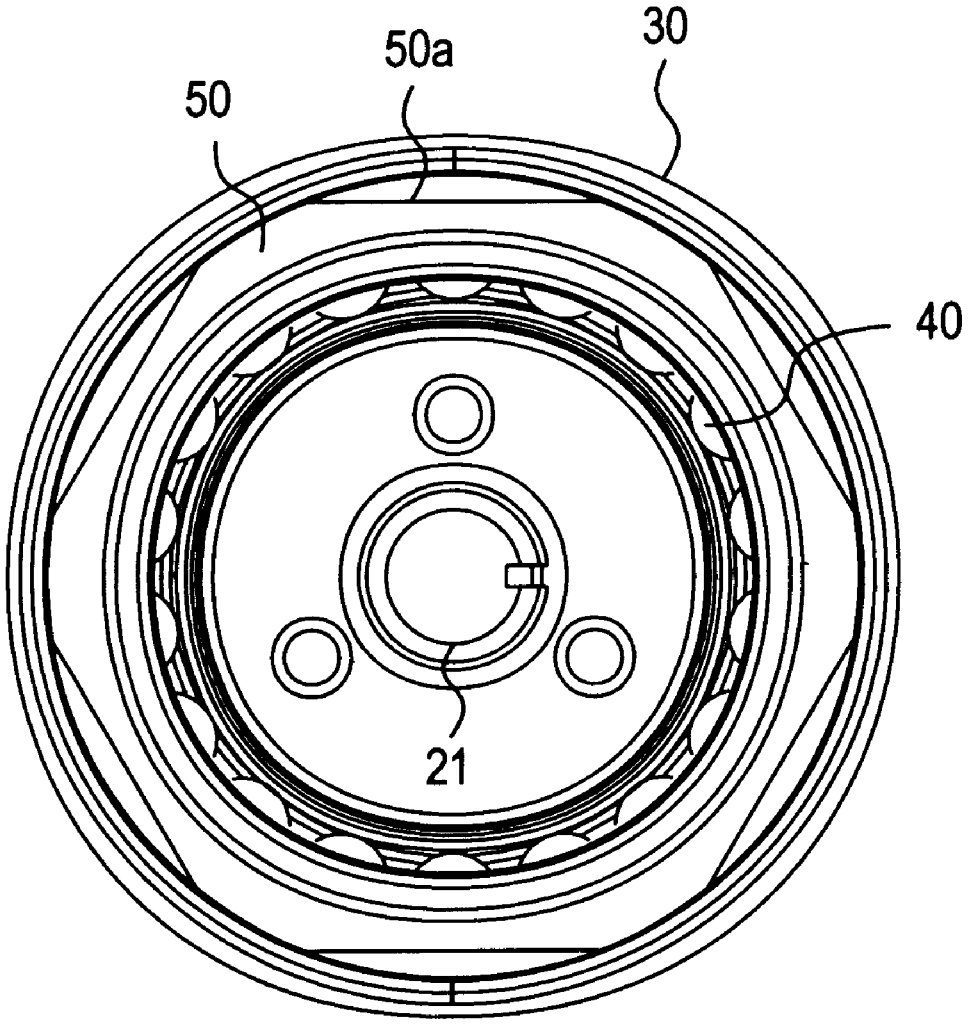
FIG. 7 is an end elevation taken from the rear end of the connector assembly of FIGS. 1–5.
Figure 8:
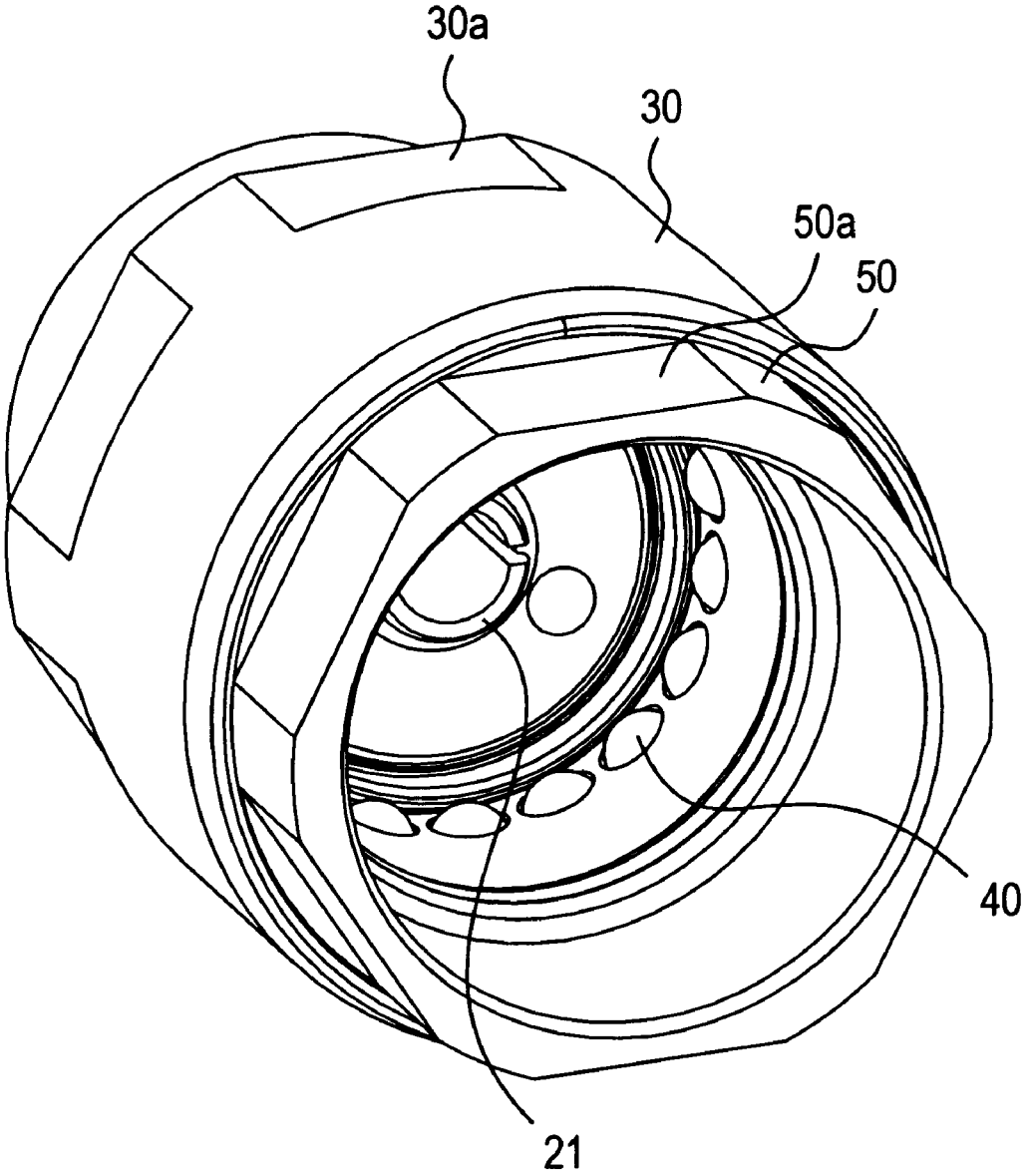
FIG. 8 is a perspective view taken from the rear end of the connector assembly of FIGS. 1–5.

Turning next to that portion of the connector assembly 5 that makes an electrical connection with the outer conductor 11 of the coaxial cable 10, the front body member 30 includes a clamping surface 32 which engages the inner surface of the corrugated outer conductor 11 adjacent the last crest in the corrugated outer conductor 11. In one embodiment, the clamping surface 32 is conically beveled, as illustrated in FIGS. 1–3. Alternatively, the clamping surface can be radiused (or rounded), or form a generally square edge. Generally, the clamping surface 32 is the end of an annulus 33 formed as an integral part of the interior of the front body member 30, and is continuous around the entire circumference of the cable to ensure good electrical contact with the inner surface of the outer conductor 11, as illustrated in FIG. 3. The clamping surface 32 is preferably formed as an integral part of the front body member 30, rather than as a separate insert, to facilitate easy handling and installation of the connector assembly 5, particularly under field conditions where small parts are often dropped and lost. As the connector assembly 5 is telescoped over the cut end of the cable 10, the leading edge of the clamping surface 32 penetrates between the inner surface of the outer conductor 11 and the foam dielectric 13 and then progressively engages a major portion of the inner surface of the outer conductor 11 between the cut end and the first valley.

For the purpose of pressing the outer conductor 11 against the clamping surface 32, a set of ball bearings 40 is carried near one end of the annular bearing sleeve 41. More specifically, the ball bearings 40 are captured between the front body member 30 and the bearing sleeve 41, with each ball bearing 40 being seated in one of a series of tapered apertures 42 spaced around the circumference of the bearing sleeve 41. The apertures 42 taper inwardly to a diameter that is only slightly smaller than that of the ball bearings 40, so that the radially inner portions of the ball bearings can project inwardly beyond the inside surface of the bearing sleeve 41. As the front body member 30 and the bearing sleeve 41 are drawn together longitudinally, a cam surface 34 on the interior of the front body member 30 engages the outer portions of the ball bearings 40 and presses the ball bearings into the apertures 42 so that the inner portions of the ball bearings 40 project through the apertures and fit into the last valley of the corrugated outer conductor 11 adjacent the end of the cable. The ball bearings 40 thus clamp the end portion of the outer conductor 11 firmly against the clamping surface 32.

In one embodiment, a connecting means draws and holds the first and second body members 30 and 50 together. This draws the clamping surface 32 and the ball bearings 40 against the inner and outer surfaces, respectively, of the outer conductor 11. In FIGS. 1–8, the connecting means is a threaded connection between the first and second body members 30 and 50. In this embodiment, the inner surface of the telescoping portion of the front body member 30 includes a first threaded surface 35 and the outer surface of the telescoping portion of the rear body member 50 includes a second threaded surface 52. The cooperating threaded surfaces 35 and 52 are adapted to draw the clamping surface 32 and the ball bearings 40 firmly against opposite sides of the flared end portion of the outer conductor 11. Therefore, when the two members 30 and 50 are rotated relative to each other in a first direction, they are advanced toward each other in the axial direction so as to draw the bearing sleeve 41 farther into the front body member 30, thus drawing the ball bearings 40 into firm engagement with the outer conductor 11. When the annular flared end portion of the outer conductor 11 is clamped between the clamping surface 32 and the ball bearings 40, the conductor 11 is pressed into firm mechanical and electrical contact with the clamping surfaces 32 to establish and maintain the desired electrical connection with the outer conductor 11. To detach the connector assembly 5 from the outer conductor 11, the front and rear body members 30 and 50 are simply rotated relative to each other in the opposite direction to retract the rear body member 50, and thus the bearing sleeve 41, away from the front body member 30 until the ball bearings 40 are clear of the cam surface 34. The one piece connector assembly 5 can then be slipped off the cable 10.

As can be seen in FIGS. 5–8, wrench flats 30*a* and 50*a* (preferably six on each member 30 and 50) are provided on the exterior surfaces of the front and rear body members 30 and 50, respectively, to receive tools, such as wrenches, for rotating the two members 30 and 50 relative to each other.

In another embodiment, the connecting means includes, for example, an air cylinder(s) attached to each of the respective body members 30 and 50 to move the two members together in a linear fashion. Alternatively, the connecting means may include an electromagnetic coil(s) attached to each of the respective body members 30 and 50 to move the two members together in a linear fashion. The connecting means may further include a bayonet mount. The connecting means may also simply press-fit or snap the two members 30 and 50 together. These and other ways of connecting the two members 30 and 50 together that are generally known to those skilled in the art are encompassed by the term "connecting means" as used herein.

The ball bearings 40 can move radially when they are not in contact with the cam surface 34, to permit them to pass over the crests of the corrugated outer conductor 11 when the bearing sleeve 41 is being moved longitudinally along the cable, during installation or removal. Consequently, when the connector assembly 5 is slipped over the cable 10 with the ball bearings 40 engaging the cut edge of the outer conductor 11, continued application of pressure to the connector assembly 5 causes the ball bearings 40 to be cammed radially outwardly by the outer conductor 11, as illustrated in FIG. 2. The ball bearings 40 are then cammed into the last valley of the corrugated outer conductor 11, as illustrated in FIG. 3, as the rear body member 50 is threaded to its fully advanced position with respect to the front body member 30, causing the cam surface 34 to press the ball bearings 40 firmly against the inner portions of the sidewalls of the tapered apertures 42, and against the outer conductor 11.

As can be seen in FIGS. 1–3, the ball bearings 40 minimize the frictional engagement between the front body member 30 and the bearing sleeve 41. Thus, the tightening of the connector assembly 5 on the cable 10 can be effected quickly and efficiently with a minimum of tightening torque. This also minimizes any damage to plated surfaces and minimizes the generation of metal flakes generated by abrasion between the body members 30 and 50 and/or the outer conductor 11, which can adversely affect electrical performance.

To provide a moisture barrier between the outer conductor 11 and the inner surfaces of the bearing sleeve 41 and the rear body member 50, an O-ring 60 is positioned in a groove formed by adjacent surfaces of the bearing sleeve 41 and the rear body member 50. Then when the rear body member 50 is advanced towards the front body member 30, an end flange 53 on the body member 50 presses the O-ring 60 against the bearing sleeve 41. This compresses the O-ring 60 so that it bears firmly against both the outer surface of the outer conductor 11 and the opposed surfaces of bearing sleeve 41 and the rear body member 50. As illustrated in FIG. 3, the O-ring 60 seals directly on a crest of the outer conductor 11. Sealing on the outer conductor 11 provides a superior moister seal as compared with sealing on the cable jacket 14. A moisture barrier similar to that provided by the resilient O-ring 60 is provided by a second O-ring 61 positioned between the opposed surfaces of a portion of the rear body member 50 and a telescoping portion of the front body member 30.

Lubrication is necessary in order to assure proper seating of the O-rings. Therefore, in one embodiment, the O-rings 60 and 61 are coated with a dry film lubrication. The typical factory applied grease or wax lubricant used in prior connectors tends to dry out over time. Thus, the present invention eliminates the need to apply lubricant in the field during installation or thereafter.

A moisture barrier similar to that provided by the resilient O-rings 60 and 61 is provided by O-rings 62 and 63 in order to provide a sealed interface. A third O-ring 62 is positioned between the insulator 23 and the opposed surface of the front portion of the front body member 30. A fourth O-ring 63 is positioned between the insulator 23 and the opposed surface of the inner connector element 20. The inner surface of a fifth O-ring 64 is exposed for resiliently engaging the outer surface of the inner connector element 20. The O-ring 64 inhibits metal chips that may be disposed in the hollow inner conductor 12 from entering the connector assembly 5 and causing interference. Such metal chips are usually produced during the installation process by cutting the cable 10.

Figure 9A:
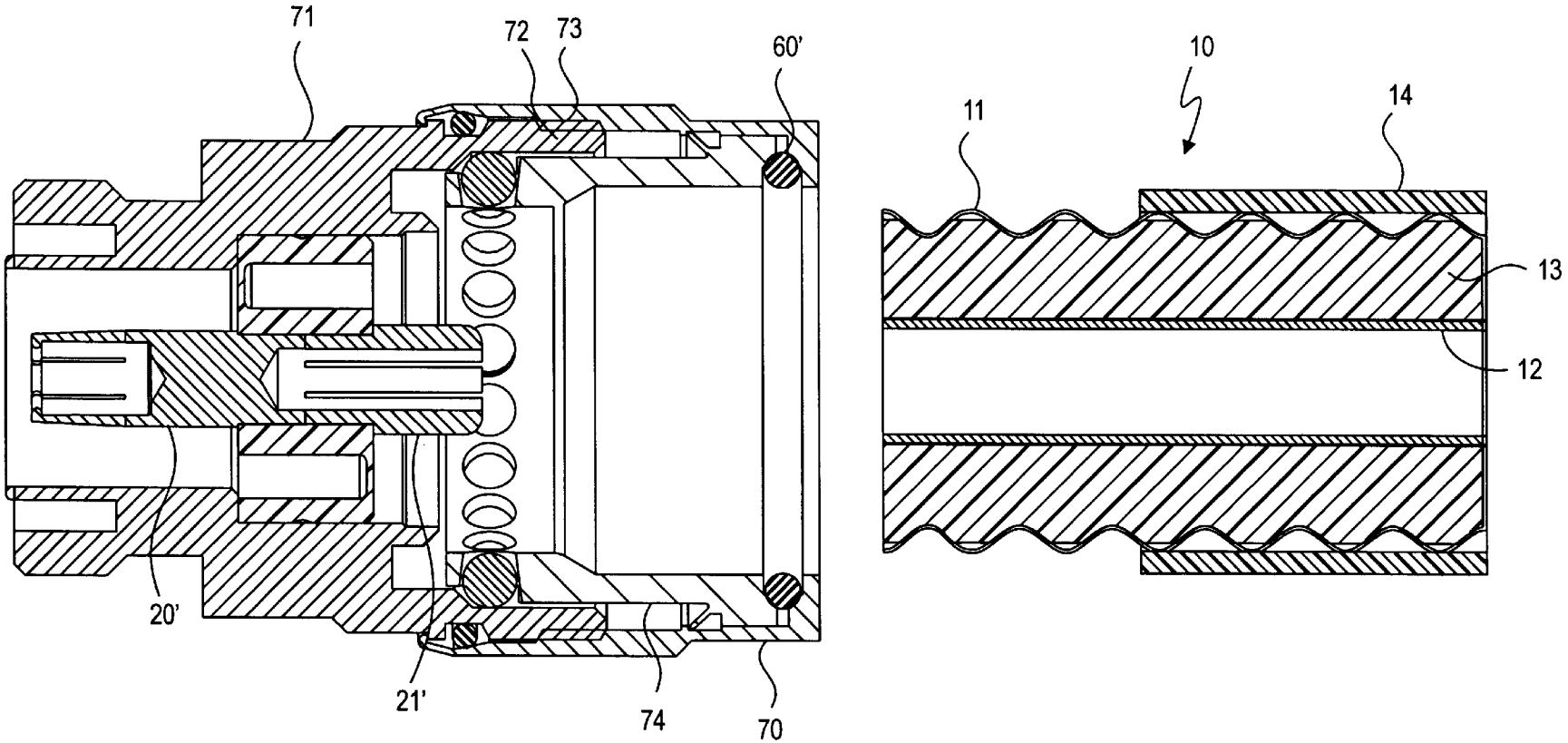
FIG. 9*a* is a longitudinal section taken through the center of a modified connector embodying the invention.
Figure 9B:
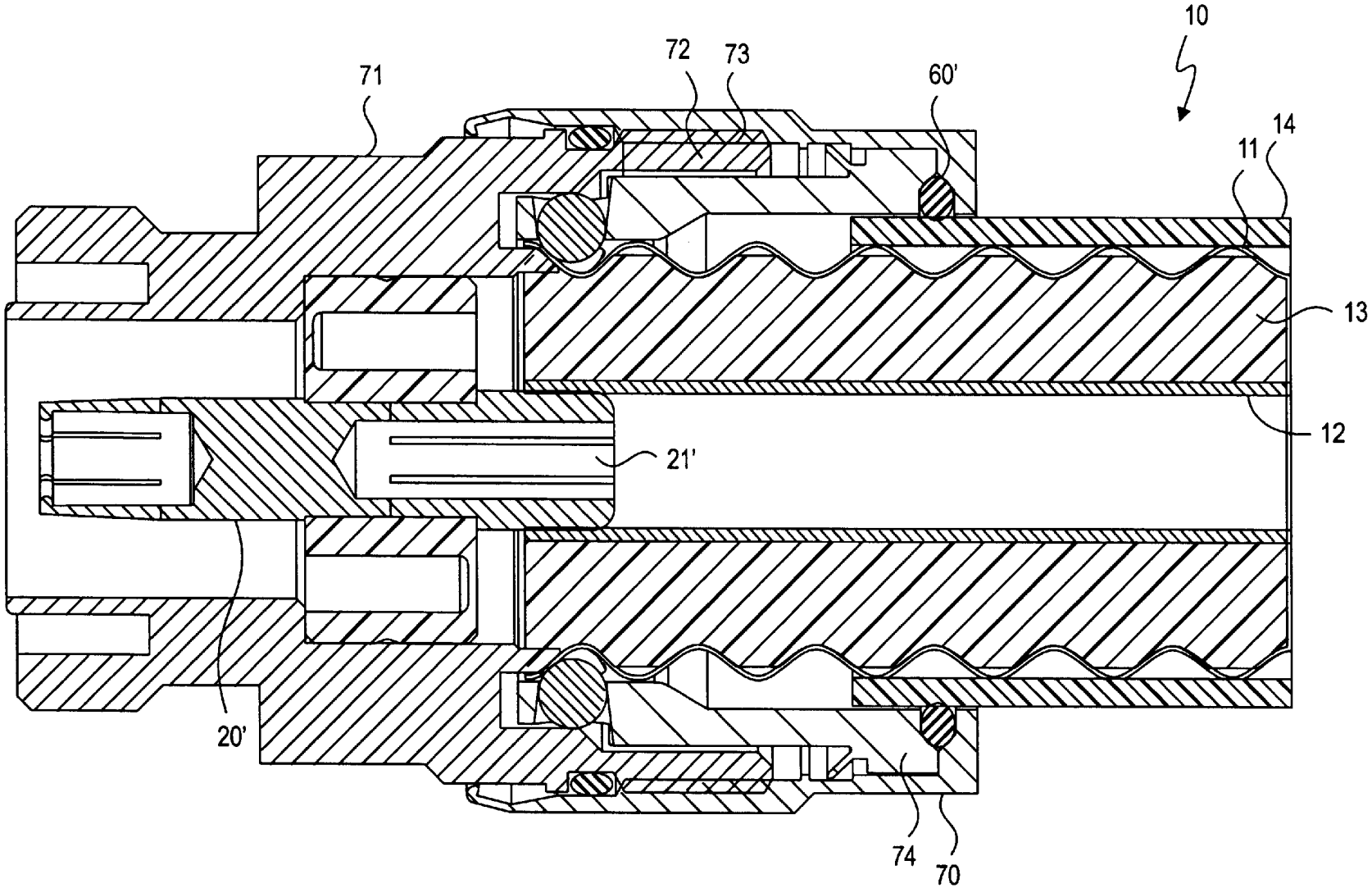
FIG. 9*b* is the same longitudinal section shown in FIG. 9*a* with the modified connector fully installed on the cable.

FIGS. 9*a* and 9*b* illustrate a modified connector in which the rear body member 70 telescopes along the outside surface, rather than along the inside surface, of the front body member 71. Thus, the first threaded surface 72 is on the outside surface of the front body member 71 and second threaded surface 73 is on the inside surface of the rear body member 70. In this modified embodiment, the exposed surface of the O-ring 60' bears firmly against the outer surface of the cable jacket 14, as opposed to the outer conductor 11. This provides a moisture barrier between the outer surface of the cable jacket 14 and the inner surfaces of the bearing sleeve 74 and the rear body member 70. Otherwise, the operation of this connector assembly is substantially similar to the embodiment of FIGS. 1–8 described above.

Figure 10:
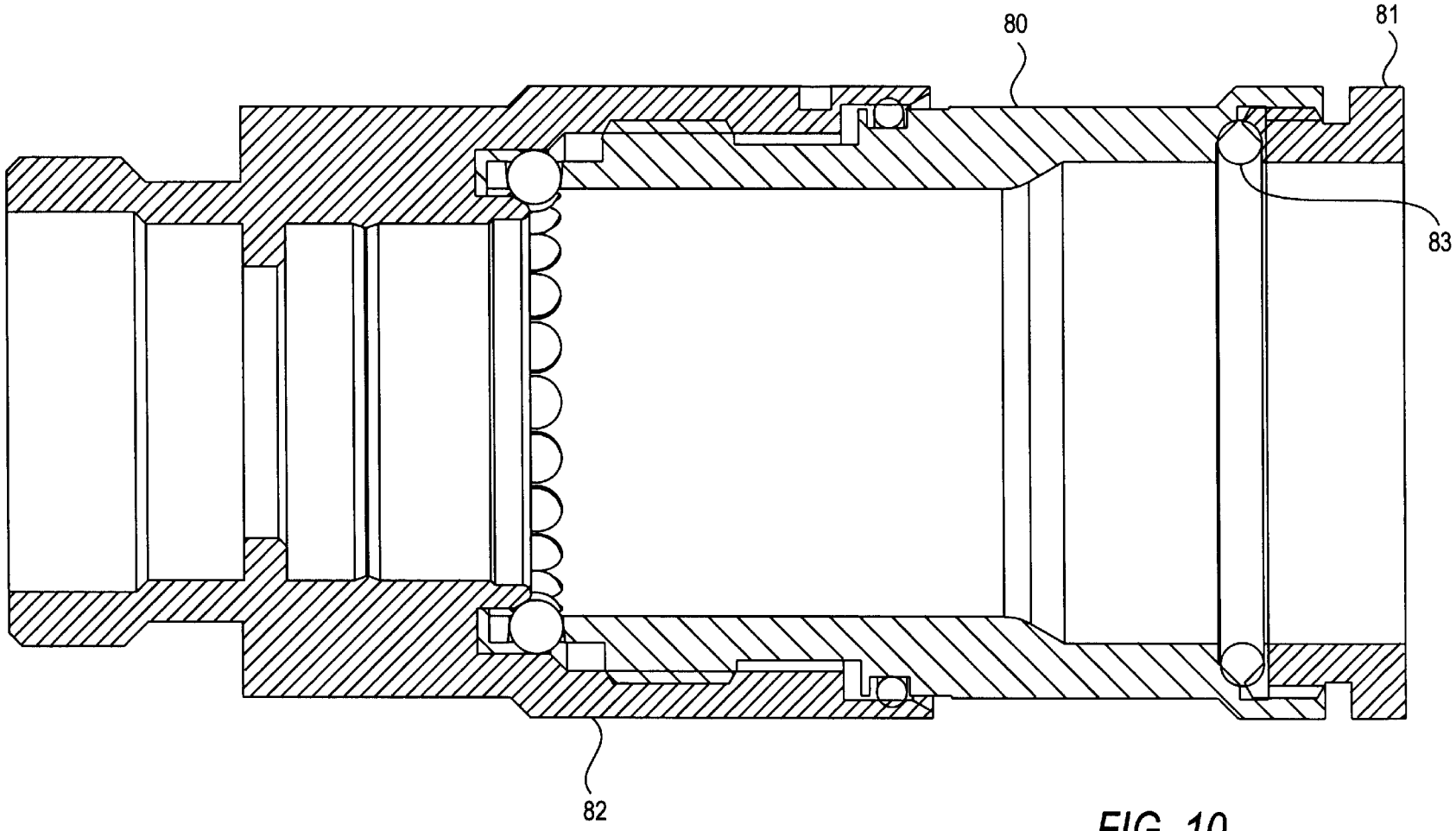
FIG. 10 is a longitudinal section taken through the center of another modified connector embodying the invention.

FIG. 10 illustrates another modified connector in which the bearing sleeve 80, rather than the rear body member 81, is threaded into the front body member 82. The rear body member 81 threads into the end of the bearing sleeve 80 and is used to position and compress the O-ring 83 therebetween. The O-ring 83 forms a moisture seal between the cable jacket and the modified connector assembly once the cable is inserted into the modified connector assembly.

Figure 11A:
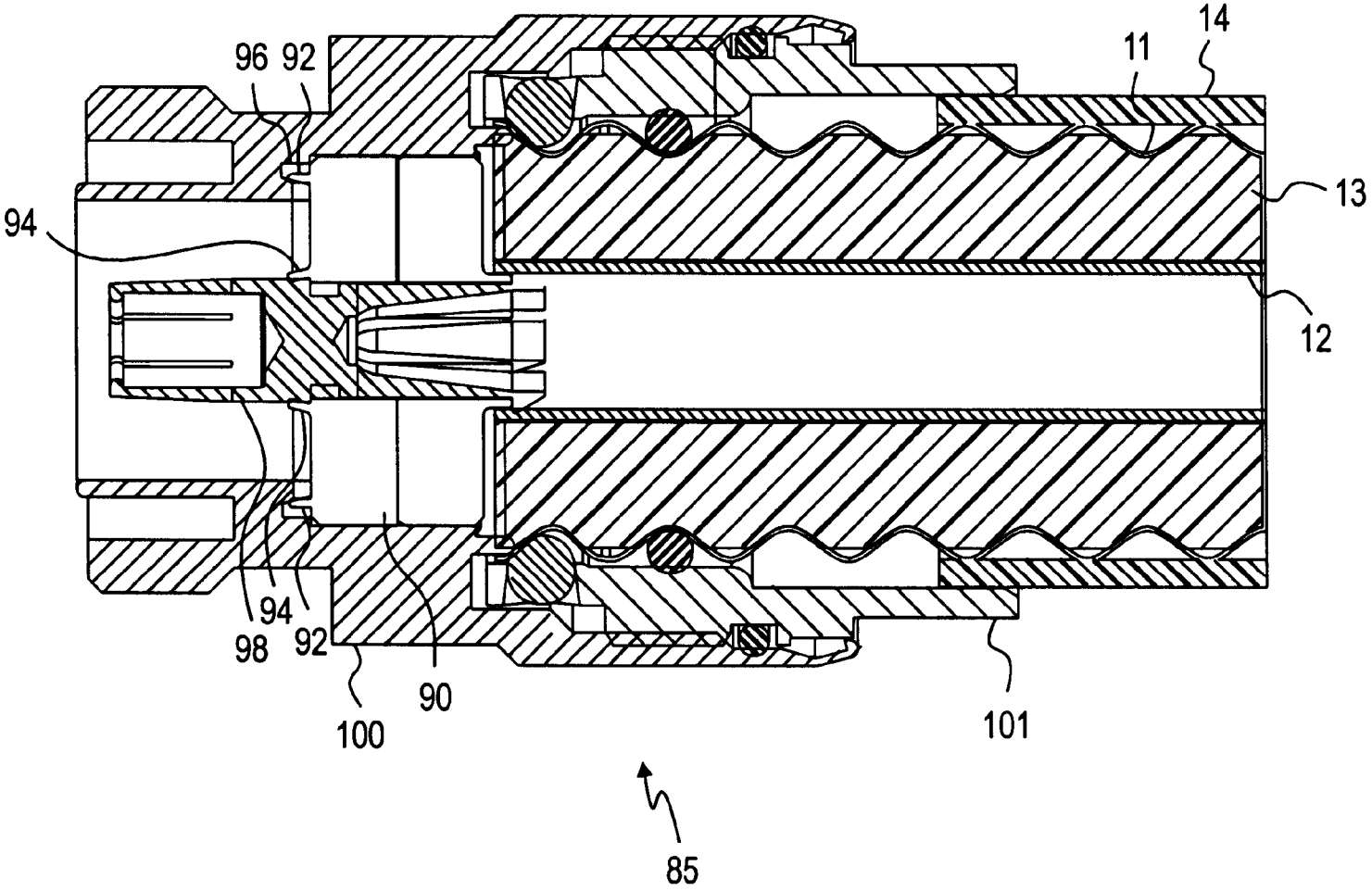
FIG. 11*a* is a longitudinal section taken through the center of another modified connector embodying the invention.
Figure 11B:
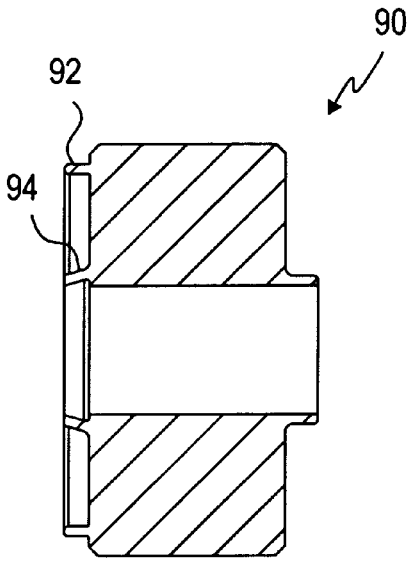
FIG. 11*b* is a cross-sectional view of an insulator for the modified connector of FIG. 11*a* taken along line 11*b*–11*b* in FIG. 11*c;*
Figure 11C:
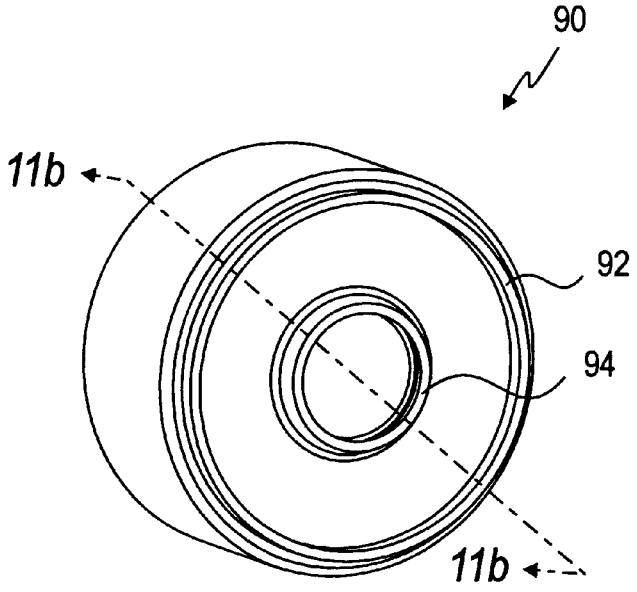

FIGS. 11*a–c* illustrate another modified connector 85. To achieve a reliable sealed interface between the cable 10 and the connector 85, a simple plastic insulator press fit into the metal front body member 100 is not sufficient because of the large difference in temperature expansion coefficients between plastic and metal, and the constraining effects of the front body member 100 at high temperatures. This will cause the plastic insulator to "cold flow", resulting in a reduced outer diameter and an elongated length of the plastic insulator after temperature cycling. The reduced outer diameter will result in a leak path between the insulator and the front body member 100 after the insulator returns to ambient temperature. Therefore, it is necessary to have some type of resilient sealing mechanism that can adjust to accommodate the dimensional changes that occur due to temperature cycling, without being constrained by the front body member 100. Traditionally, commercially available "O-rings" were used to achieve this resilient seal. However, O-rings increase the number of parts, cost, and assembly time required to assemble the connector 85. Therefore, an insulator 90 is used in one embodiment of the claimed invention to provide a resilient seal. This insulator 90 is molded with a pair of integral resilient sealing rings 92 and 94. The outer diameter of the sealing rings 92 and 94 is not constrained by the front body member 100. Instead, the sealing rings 92 and 94 are free to flex and move with temperature cycling and can expand as temperatures increase without being forced to "cold flow".

The outer sealing ring 92 fits into a mating groove 96 in the front body member 100. The mating groove 96 allows good sealing performance to be maintained between the front body member 100 and the insulator 90, even at cold temperatures, because the groove 96 serves to increase the sealing pressure as the insulator 90 shrinks relative to the front body member 100. Specifically, the groove 96 allows the outer sealing ring 92 to shrink at substantially the same rate, at cold temperatures, as the front body member 100. This minimizes the likelihood of a leak path between the outside environment and the hollow inner conductor 12. The inner sealing ring 94 seals adjacent to the inner connector element 98 in the front body member 100 to minimizes the likelihood of a leak path between the outside environment and the hollow inner conductor 12.

Figure 12:
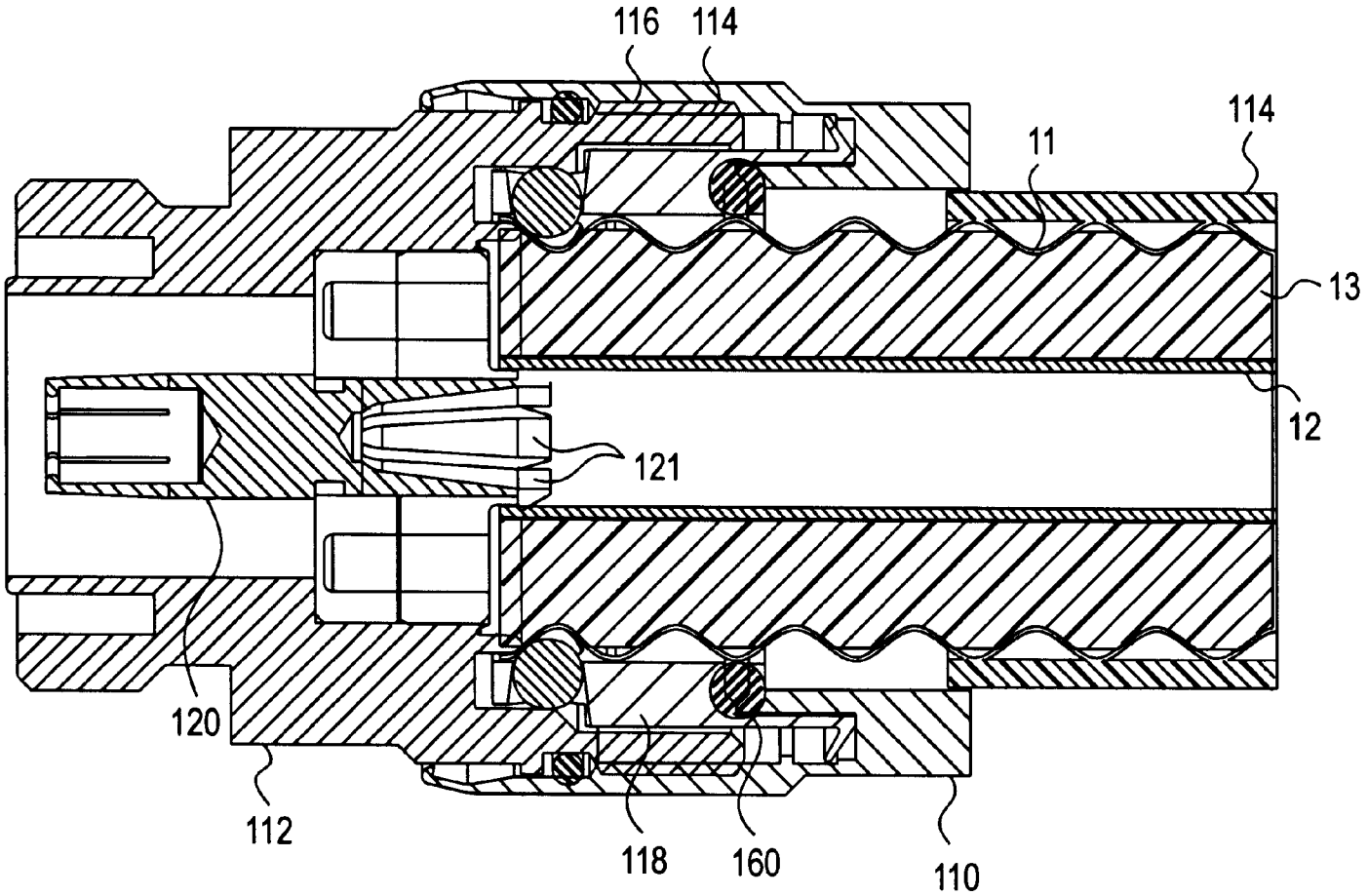
* and FIG. 12 is a longitudinal section taken through the center of another modified connector embodying the invention.

FIG. 12 illustrates a modified connector in which the rear body member 110 telescopes along the outside surface, rather than the inside surface, of the front body member 112. Thus, the first threaded surface 114 is on the outside surface of the front body member 112 and the second threaded surface 116 is on the inside surface of the rear body member 110. In this modified connector, the exposed surface of an O-ring 160 bears firmly against the outer conductor 11, as opposed to the outer surface of the cable jacket 14. This provides a moisture barrier between the outer conductor 11 and the inner surfaces of the bearing sleeve 118 and the rear body member 110. In this modified connector, electrical contact with the inner conductor 12 is effected by an inner connector element 120 forming multiple spring fingers 121 which are deflected slightly inwardly as they are inserted into the hollow conductor 12, so that the resulting spring forces hold the spring fingers 121 tightly against the inside surface of the inner conductor 12. Otherwise, the operation of this connector assembly is similar to the embodiment of FIGS. 1–8 described above.

As can be seen from the foregoing detailed description of the illustrative embodiments of the invention, the improved connector assembly 5 is easy to install, remove, and re-install, even under adverse field conditions. All the parts of the connector assembly 5 can be pre-assembled into a one piece connector, so that the possibility of dropping and losing small parts in the field is minimized. Also, the connector assembly 5 can be easily installed, and removed, with the use of conventional tools, so that no special equipment is required. Moreover, the connector assembly provides positive electrical contact, particularly with the annularly corrugated outer conductor, to ensure reliable electrical performance. Furthermore, the connector assembly 5 can be efficiently and economically manufactured so that all the practical and performance advantages of the connector assembly 5 are achieved without any significant economic sacrifice.

The above detailed description of the various embodiments of the present invention is for illustrative purposes only and it is not intended to limit the present invention in any manner. Other aspects, features, advantages and modifications of the present invention will become apparent to those skilled in the art upon studying this invention. All such aspects, features, advantages and modifications of the present invention are intended to be within the scope of the present invention as defined by the claims.

What is claimed is:

1. A connector assembly for a coaxial cable having an annularly corrugated outer conductor, said connector assembly comprising:

a first body member adapted to fit over the end of the coaxial cable and forming a series of apertures spaced around the circumference of said first body member near one end thereof;

a second body member forming a clamping surface for engaging the inner surface of said corrugated outer conductor adjacent the last crest in said corrugated outer conductor;

multiple ball bearings seated in said apertures and captured between said first and second body members; and a connecting means for drawing and holding the first and second body members together so as to draw said clamping surface and said ball bearings against the inner and outer surfaces, respectively, of said outer conductor.

2. The connector assembly of claim 1, wherein said connecting means is a threaded connection between the first and second body members.

3. The connector assembly of claim 1, wherein said ball bearings are larger than said apertures and are positioned on an outer surface of said first body member, said second body member forming a cam surface for engaging the outer portions of said ball bearings and urging said ball bearings into said apertures as the first and second body members are drawn together such that the inner portions of said ball bearings extend through said apertures and press against the outer surface of said outer conductor.

4. The connector assembly of claim 1, further including an O-ring captured within said first body member, the inner surface of said O-ring being exposed for engaging the outer surface of said outer conductor to provide a moisture seal between said outer conductor and said connector assembly.

5. The connector assembly of claim 4, wherein said inner surface of said O-ring is coated with a dry film lubrication.

6. The connector assembly of claim 1, further including an O-ring captured within said first body member, the inner surface of said O-ring being exposed for engaging the outer surface of said cable to provide a moisture seal between said cable and said connector assembly.

7. The connector assembly of claim 1, further including an O-ring captured between an outer surface of said first body member and an inner surface said second body member to provide a moisture seal between said first and second body members.

8. The connector assembly of claim 1, wherein said cable includes a hollow inner conductor, said connector assembly further including an inner connector element and an O-ring, the inner surface of said O-ring being exposed for resiliently engaging the outer surface of said connector element to inhibit metal chips from within said hollow inner conductor from entering said connector assembly.

9. The connector assembly of claim 1, wherein said cable includes an insulator having integral inner and outer resilient sealing rings, said outer sealing ring adapted to fit into a mating groove in said second body member, said inner sealing ring adapted to fit adjacent to an inner connector element in said second body member.

10. The connector assembly of claim 1, wherein said corrugated outer conductor is cut off at substantially the apex of one of the crests of the corrugations.

11. The connector assembly of claim 1, wherein said first body member includes a bearing sleeve, said second body member includes an integral telescoping sleeve, said bearing sleeve and said telescoping sleeve capturing said ball bearings therebetween.

12. The connector assembly of claim 1, wherein said first and second body members include respective integral telescoping sleeves, said sleeves including first and second threaded surfaces, respectively.

13. The connector assembly of claim 1, wherein said second body member includes an inner connector element having a C-shaped spring.

14. The connector assembly of claim 1, wherein said first body member telescopes along the outside surface of the second body member.

15. The connector assembly of claim 1, wherein said second body member telescopes along the outside surface of the first body member.

16. A connector assembly for a coaxial cable having an annularly corrugated outer conductor, said assembly comprising:

a first body member telescoped over the end of the coaxial cable;

a bearing sleeve mechanically fastened at a distal end of said first body member, said bearing sleeve forming a series of apertures spaced around the circumference of said bearing sleeve near one end thereof;

a second body member forming a clamping surface for engaging the inner surface of said corrugated outer conductor adjacent the last crest in said corrugated outer conductor;

multiple ball bearings seated in said apertures and captured between said bearing sleeve and said second body member; and a connecting means for drawing and holding the first and second body members together so as to draw said clamping surface and said ball bearings against the inner and outer surfaces, respectively, of said outer conductor.

17. The connector assembly of claim 16, wherein said ball bearings are larger than said apertures and are positioned on an outer surface of said bearing sleeve, said second body member forming a cam surface for engaging the outer portions of said ball bearings and urging said ball bearings into said apertures as the first and second body members are drawn together such that the inner portions of said ball bearings extend through said apertures and press against the outer surface of said outer conductor.

18. The connector assembly of claim 16, further including an O-ring captured between said first body member and said bearing sleeve, the inner surface of said O-ring being exposed for engaging the outer surface of said outer conductor to provide a moisture seal between said outer conductor and said connector assembly.

19. The connector assembly of claim 16, further including an O-ring captured between said first body member and said bearing sleeve, the inner surface of said O-ring being exposed for engaging the outer surface of said cable to provide a moisture seal between said cable and said connector assembly.

20. The connector assembly of claim 16, further including an O-ring captured between an outer surface of said first body member and an inner surface said second body member to provide a moisture seal between said first and second body members.

21. The connector assembly of claim 16, wherein said cable includes a hollow inner conductor, said connector assembly further including an inner connector element and an O-ring, the inner surface of said O-ring being exposed for resiliently engaging the outer surface of said connector element to inhibit metal chips from within said hollow inner conductor from entering said connector assembly.

22. The connector assembly of claim 16, wherein said cable includes an insulator having integral inner and outer resilient sealing rings, said outer sealing ring adapted to fit into a mating groove in said second body member, said inner sealing ring adapted to fit adjacent to an inner connector element in said second body member.

23. The connector assembly of claim 16, wherein said corrugated outer conductor is cut off at substantially the apex of one of the crests of the corrugations.

24. The connector assembly of claim 16, wherein said second body member includes an integral telescoping sleeve, said bearing sleeve and said telescoping sleeve capturing said ball bearings therebetween.

25. The connector assembly of claim 16, wherein said first and second body members include respective integral telescoping sleeves, said sleeves including first and second threaded surfaces, respectively.

26. The connector assembly of claim 16, wherein said second body member includes an inner connector element having a C-shaped spring.

27. The connector assembly of claim 16, wherein said first body member telescopes along the outside surface of the second body member.

28. The connector assembly of claim 16, wherein said second body member telescopes along the outside surface of the first body member.

29. A method of making a connector assembly for a coaxial cable having an annularly corrugated outer conductor, said method comprising the steps of:

forming a first body member that is adapted to fit over the end of the coaxial cable;

forming a series of apertures spaced around the circumference of said first body member near one end thereof;

forming a second body member having a clamping surface for engaging the inner surface of said corrugated outer conductor adjacent the last crest in said corrugated outer conductor;

seating multiple ball bearings in said apertures;

capturing said ball bearings between said first and second body members;

drawing and holding the first and second body members together so as to draw said clamping surface and said ball bearings against the inner and outer surfaces, respectively, of said outer conductor.

30. The method of claim 29, further including the steps of:

positioning said ball bearings on an outer surface of said first body member; and forming a cam surface in said second body member for engaging the outer portions of said ball bearings and urging said ball bearings into said apertures as the first and second body members are drawn together such that the inner portions of said ball bearings extend through said apertures and press against the outer surface of said outer conductor.

31. The method of claim 29, further including the steps of:

capturing an O-ring within said first body member; and engaging the inner surface of said O-ring on the outer surface of said outer conductor to provide a moisture seal between said outer conductor and said connector assembly.

32. The method of claim 29, further including the steps of:

capturing an O-ring within said first body member; and engaging the inner surface of said O-ring on the outer surface of said cable to provide a moisture seal between said cable and said connector assembly.

33. The method of claim 29, further including the step of capturing an O-ring between an outer surface of said first body member and an inner surface said second body member to provide a moisture seal between said first and second body members.

34. The method of claim 29, wherein said cable includes a hollow inner conductor, and further including the steps of:

forming an inner connector element in said second body member; and resiliently engaging the inner surface of an O-ring around the outer surface of said inner connector element to inhibit metal chips from within said hollow inner conductor from entering said connector assembly.

35. The method of claim 29, further including the steps of:

fitting an insulator having integral inner and outer resilient sealing rings into said second body member;

fitting said outer sealing ring into a mating groove in said second body member; and securing said inner sealing ring adjacent to an inner connector element in said second body member.

36. The method of claim 29, further including the step of cutting said corrugated outer conductor off at substantially the apex of one of the crests of the corrugations.

37. The method of claim 29, further including the step of capturing said ball bearings between a bearing sleeve of said first body member and an integral telescoping sleeve of said second body member.

38. The method of claim 29, further including the step of forming an inner connector element in said second body member, said connector element having a C-shaped spring.

39. The method of claim 29, further including the step of telescoping said first body member along the outside surface of the second body member.

40. The method of claim 29, further including the step of telescoping said second body member along the outside surface of the first body member.

* * * * *